United States Patent [19]

Simshauser

[11] Patent Number: 4,561,215

[45] Date of Patent: Dec. 31, 1985

[54] STYLUS LAPPING CONTROL

[75] Inventor: Elvin D. Simshauser, Columbus, N.J.

[73] Assignee: RCA Corporation, Princeton, N.J.

[21] Appl. No.: 593,092

[22] Filed: Mar. 26, 1984

[51] Int. Cl.[4] ..... B24B 9/16

[52] U.S. Cl. ..... 51/165.75; 51/125.5; 51/165.76; 51/229; 51/283 R

[58] Field of Search ..... 51/229, 165 R, 165.75, 51/165.76, 283 R, 125.5

[56] References Cited

U.S. PATENT DOCUMENTS

| | | | |
|---|---|---|---|
| 2,395,952 | 3/1946 | Bartnovsky | 51/229 |
| 2,449,423 | 9/1948 | Spira | 51/229 |
| 2,829,472 | 4/1958 | Salzer | 51/229 |
| 3,624,968 | 12/1971 | Leibowitz | 51/229 |
| 3,862,517 | 1/1975 | Porter | 51/165.75 |
| 3,902,283 | 9/1975 | Bean | 51/229 |
| 4,286,414 | 9/1981 | Ziegel | 51/229 |
| 4,403,453 | 9/1983 | Cave et al. | 51/124 R |

*Primary Examiner*—Harold D. Whitehead

*Attorney, Agent, or Firm*—Birgit E. Morris; Donald S. Cohen; Edward J. Sites

[57] ABSTRACT

The lapping of a facet into a conical diamond tip brazed to a metallic (titanium) shank is controlled by sensing an electrical pulse generated when the diamond facet is enlarged in the vicinity of the titanium shank. A pulse detecting circuit responding to the pulse generates a control signal for energizing a mechanism to lift the stylus from the lapping scaife to cease lapping.

4 Claims, 4 Drawing Figures

STYLUS LAPPING CONTROL

This invention relates to lapping a conical tipped diamond stylus to provide a facet for the stylus.

BACKGROUND OF THE INVENTION

Information playback systems frequently utilize a stylus for reading signals from the surface of an information record. A stylus may be formed of a very small diamond mounted and bonded to a metallic, typically, titanium, shank. In order to provide proper playing performance from the stylus, it is necessary to lap certain flat surfaces on the diamond. Such lapping operations must be closely controlled. Insufficient lapping results in a small flat of inadequate size and shape. Moreover, over lapping can extend into the titanium shank. Cutting the titanium shank can contaminate the lapping disc (typically termed a scaife). In extreme cases, the bond of the diamond to the titanium can be weakened. The problem is further complicated by the fact that it is desirable to use diamonds that are not oriented crystallographically. Since the lapping rate of a diamond can vary by as much as a factor of three to one, depending on the orientation of the diamond on the shank, there is a corresponding variation in the lapping time needed to develop properly the desired flat or facet. It is possible to remove the styli and inspect them optically several times during the lapping procedures, but such inspections are time consuming. It is desirable, therefore, to control accurately the lapping of the diamond.

SUMMARY OF THE INVENTION

The invention controls the lapping of a stylus having a conical diamond tip bonded to a metallic shank. The stylus is removeably supported in contact with the surface of a rotating electrically conducting scaife. A DC bias establishes an electrical field between the shank and the scaife. A detector coupled to the stylus provides an electrical control signal in response to an electrical signal generated when the diamond tip is sufficiently lapped to lower the conductive shank close enough to the scaife to break down the electric field. The control signal is used to actuate a mechanism for lifting or removing the stylus tip from contact with the scaife and thereby cease lapping the stylus.

DETAILED DESCRIPTION OF THE PREFERRED EMBODIMENTS OF THE INVENTION

This invention is concerned with the fabrication of a stylus in apparatus 10 following the step by which a stylus tip has been coned, as described, for example, in U.S. Pat. No. 4,403,453 issued to E. F. Cave and J. J. Cowden on Sept. 13, 1983, incorporated herein by reference.

Figure 2:
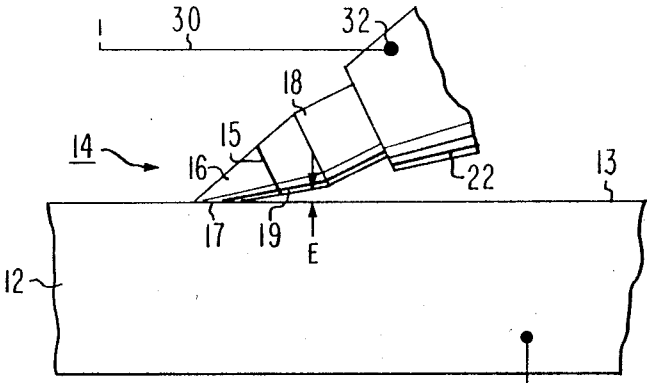
FIG. 2 is an enlarged portion of the stylus shown in FIG. 1.

A stylus 14 is formed of a conically shaped diamond tip 16 brazed to a titanium shank 18 at braze line 15 and held by a holder 20 coupled to the shank 18 by a collet 22. One form of the holder 20 is described in U.S. Pat. No. 4,286,414, issued to D. H. Ziegel on Sept. 1, 1981, incorporated herein by reference. A scaife 12 is formed of iron into the surface 13 of which diamond particles are pressed. The diameter of the diamond particles are on the order of 0.25 to 0.5 micrometer (μm). The diamond loaded surface 13 of the scaife 12 serves to abrade the diamond tip 16. The scaife 12, while being rotated with the stylus 14 positioned on the surface 13 thereof, will abrade the diamond tip 16 to form a facet 17, as shown in FIG. 2. While the diamond tip 16 is being lapped, a slurry of diamonds placed on the surface 13 reduces the abrasion time. The diamond slurry is formed of diamonds of a diameter of approximately 0.1 micrometer in a vehicle of, for example, kerosene and paint thinner.

The stylus 14 is suitably supported by a control mechanism 24 including a stepper-motor serving to support the stylus 14 on the scaife surface 13 and to provide a means to withdraw the stylus from contact with the surface. A weight 26 serves as a force to press the diamond tip 16 against the surface 13. The magnitude W of weight 26, or the position of weight 26, is selected to provide a desired force, as will be further explained.

A bias supply 28 provides a DC voltage of a selected value within a range of 5 to 100 volts to the metallic collet 22 through a resistor R and a conductor 30. The conductor 30 is connected to the shank 18 via a terminal or connection 32 on collet 22. With the stylus 14 in place on the surface 13, an electric field E (FIG. 2) is established by bias supply 28 applied across the titanium shank 18 and the surface 13 of the scaife 12. The field E may break down and develop an electrical arc or pulse between the shank 18 and the surface 13 before an actual direct current path is established as a result of lapping into the shank 18, as will be explained. Conductor 30 is also connected to the input terminal 34 of a pulse detection circuit 36. One form of a pulse detection circuit is shown in FIG. 3, to be described.

The output terminal 38 of detector circuit 36 is coupled via a conductor 37 to the input terminal **39*a* of a latch circuit 39. Latch circuit 39 responds to the leading edge of a signal A, such as a pulse having an initial transient of less than 1 microsecond (μs) and recovery transient of 1 to 100 milliseconds, to provide at terminal 39*b* a control signal B. Signal B is conducted via a conductor 40 to a lapping control circuit 44, and to a visual display 42**, if desired, such as a cathode ray tube.

Lapping control circuit 44 provides a mechanical connection 46 to the stepper-motor control mechanism 24, which, when suitably energized, either withdraws the stylus 14 from the scaife surface 13 or returns it along a direction to the surface thereof, as indicated by double-arrow 25. Control circuit 44 may be provided with a drive amplifier responding to signal B to energize the stylus lifting mechanism 24. See, for example, the above-identified U.S. Pat. No. 4,403,453 for a description of one form of mechanism for lifting the stylus 18 from the surface 13.

Figure 4:
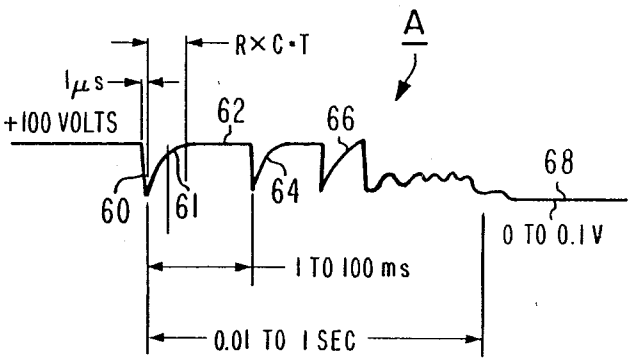
FIG. 4 are waveforms used in one embodiment of the invention to be described.
Figure 4:
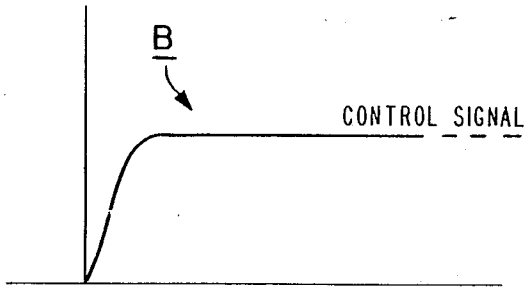
Figure 3:
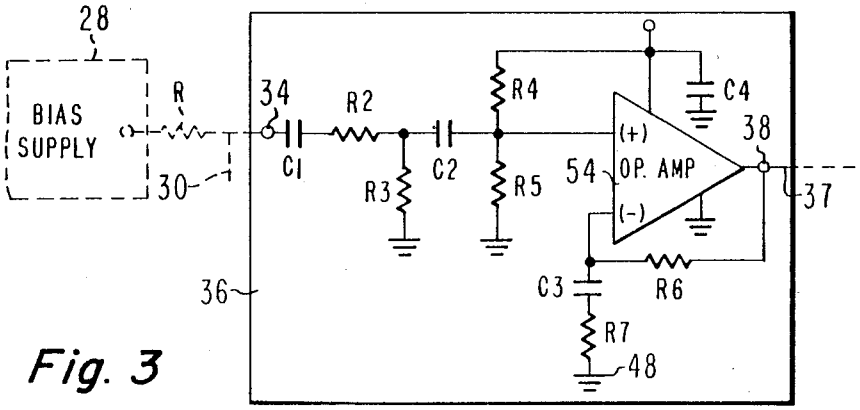
FIG. 3 is a schematic of one form of the pulse detection circuit shown in FIG. 1.

Reference is now made to FIG. 3 for a description of one embodiment of the detection circuit 36. Bias supply 28 provides a DC current through the resistor R to the input terminal 34 of the circuit. Resistor R serves as a current limiting resistor to prevent damage in case of a continuous short circuit between the shank 18 and the surface 13 of the scaife 12. Moreover, resistor R serves as a load resistor for the detected electrical signal A having a waveform, as shown in FIG. 4, that appears at the input terminal 34 produced when the shank 18 approaches the scaife surface 13 close enough to establish an electrical path thereto by a break down of the electric field E.

Figure 1:
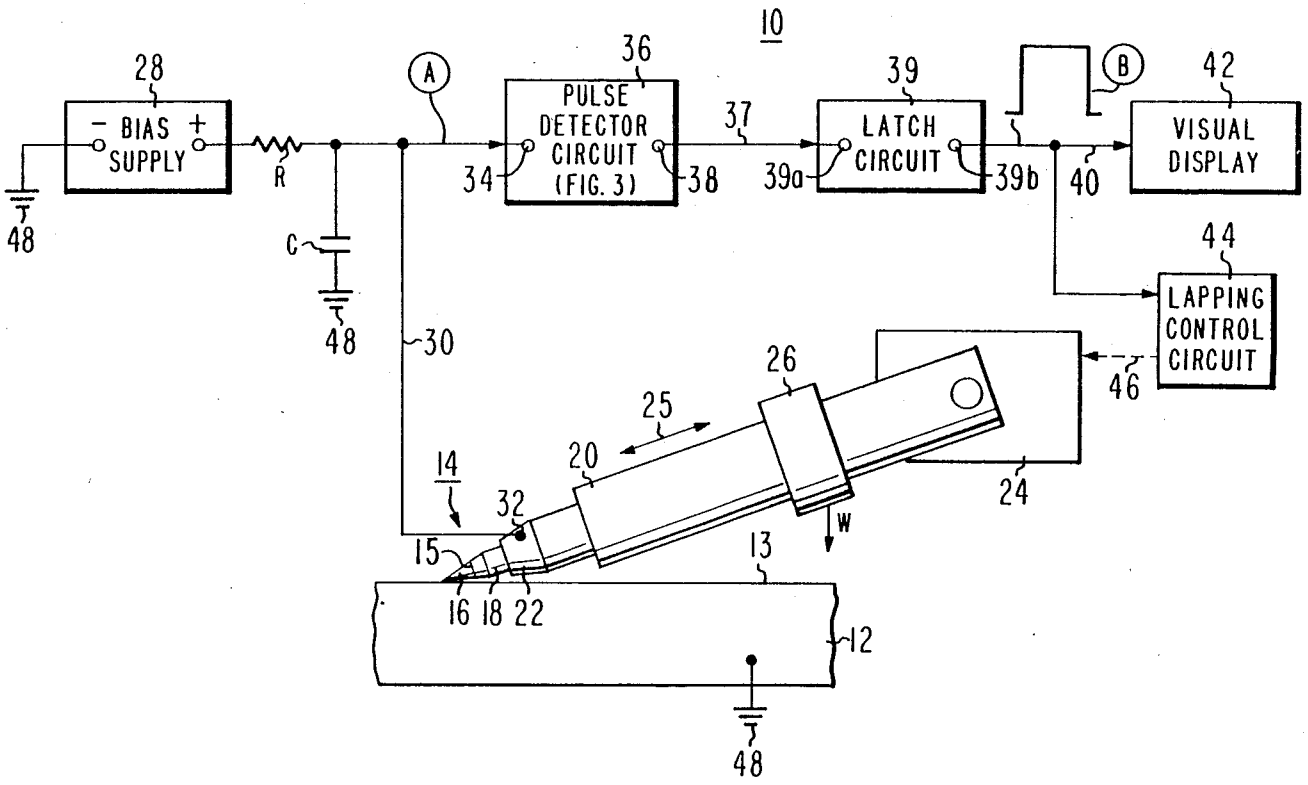
FIG. 1 is a block schematic of the apparatus used in the practice of the invention.

The waveform of signal A is formed initially by the transient portion 60 representing the rapid change in voltage from +100 volts towards zero volts in about 1 microsecond. The capacitor C (FIG. 1) and resistor R network function to shape the return portion 61. A time constant T for at least the initial pulse 60 of signal A is determined by the value of resistor R and the value of capacitor C. Capacitor C may be a discrete capacitor of a value of about 0.1 microfarad ($\mu$f) when the resistor R is about 10 kilohms whereby T is 1 millisecond (ms). If the value of resistor R is about 20 megohms, then the capacitor C may be about 40 micro-microfarads ($\mu\mu$f) as manifested by the distributed capacitance of the wire or conductor 30 relative to the ground 48, whereby the time constant T is 0.8 millisecond.

Capacitor C1 blocks the DC voltage from the bias supply 28 but passes the transients (60, 61, etc.) of signal A. Resistors R2 and R3 attenuate by a factor of about 100 to 1 the transients of the signal A and any noise that may be sensed to prevent damage to the operational amplifier 54. Capacitor C2 in combination with the resistors R4 and R5 forms a high pass filter which attenuates power line hum and other low frequency noise. Additional high pass filtering is provided by resistors R6, R7 and capacitor C3. Capacitor C4 is a power supply filter which minimizes power supply noise and prevents oscillation of the operational amplifier 54. When the bias supply 28 is 100 volts, negative going pulses of signal A of about 6 volts and 1.0 millisecond duration are produced at the output 38 of the operational amplifier 54.

The diamond tip 16, during the lapping operation of the diamond tip 16 on the iron scaife 12 having embedded diamonds, is literally bouncing over the surface 13. The amount of bouncing is dependent, in part, on the rotation speed of the scaife 12 and the magnitude W of the weight 26 forcing the tip 16 against the surface. In one embodiment, the weight 26 is 2 grams. In such an embodiment, the time to abrade the diamond tip 16 to provide a full-sized facet 17 takes about 30 seconds to 2 minutes with a scaife rotating at about 4,000 rpm. In such an embodiment, the resistance R1 is 20 megohms and the bias supply 28 provides a 100 volts DC.

In the form of the pulse detection circuit 36 described above, as shown in FIG. 3, the following values are listed for one form of that circuit in which operational amplifier 54 is suitably a type RCA CA 3140:

R 20 meg
R2 20 meg
R3 200K ohms
R4 20 meg
R5 20 meg
R6 6.2 kilohms
R7 620 ohms
C1 0.01 $\mu$f
C2 10 $\mu$f
C3 0.47 $\mu$f
C4 0.1 $\mu$f The shank 18 of the stylus 14, shown enlarged in FIG. 2, is typically and preferably formed of titanium which is brazed to the diamond tip 16 along braze line 15. Titanium is extremely susceptible to oxidation and, accordingly, forms an oxide layer on its bare surface when exposed to air. This layer is formed continuously but the rate of formation is reduced as the layer thickens. Thus, as known, bare titanium in an ambient atmosphere and temperature can form an oxide layer at rates approaching 1 angstrom per microsecond. However, as the oxide layer approaches a few hundred angstroms in thickness, the oxidizing rate reduces so much that it is impossible to detect the formation of additional oxide. An oxide layer of a few hundred angstroms is actually present on the titanium shank as lapping begins. This oxide layer is sufficiently insulating to prevent significant current flow if contact was made to the conducting portion of the electrically-grounded scaife 12. As lapping proceeds, the thickness of the oxide layer tends to be reduced. However, the oxide layer formation rate increases very quickly due to the effects of reduced thickness and increased temperature caused by the friction of the lapping action. The layer formation rate increases to equal the removal rate rapidly and a "stable" oxide thickness is established.

Using a lapping weight 26 of 2 grams, it has been experimentally determined that a minimum of 40 to 60 volts from bias supply 28 is required to break down such a "stable" oxide thickness. Thus, 100 volts for supply 28 is preferred to insure reliable operation to detect the pulses 60 and 64. This bias voltage applied across this stable thickness state produces a voltage gradient sufficient to break down the insulation of the oxide and produce a detectable current flow as manifested by a pulse, such as a pulse 60 of signal A, shown in FIG. 4, when the facet 17 is enlarged to approach or extend into titanium shank 18. It has been determined experimentally that, for a light weight 26, for example, 2 grams, the bouncing effect precludes a DC signal 68 from ever being generated.

It should be noted that the scaife surface 13 is essentially conductive with peaks of diamond particles extending therefrom. Accordingly, as the diamond tip 16 is lapped over the surface, the skipping and bouncing effect is caused by the diamond tip 16 skipping from one diamond particle to another or from one metallic surface portion of the scaife 12 to another, etc. Whatever the actual operation or mechanism of the lapping operation, pulses of current flow appear on the lead 30 and are applied to the pulse detection circuit 36. The duration of a pulse, particularly the first pulse 60 of the waveform of signal A, has a very rapid transient of about 1 microsecond and recovers along portion 61 for periods in the range of 0.1 to 1.0 millisecond, as shown in FIG. 4. As the facet 17 enlarges, the pulses 64, 66, etc., become of shorter duration until finally there is a continuous DC voltage as shown by line 68 of about 0 to 0.1 volt. The time from the first pulse 60 to the steady state voltage 68 varies in duration in the range of 0.01 to 1 second, depending upon the size of the facet 17 and other variables, such as the lapping force due to the weight 26 and the crystallographic orientation of the diamond.

Pulse detection circuit 36 responding to the waveform of signal A provides a signal to the latch circuit 39 which, in turn, provides the control signal B which is operative at, for example, +5 volts. Signal B is initiated during the initial portion of pulse 60 of signal A. Signal B is applied to the visual display 42 and to the lapping control circuit 44. The display is typically a CRT which will show the waveform of signal B indicating to the operator that the lapping operation has been completed as manifested by the facet 17 becoming large enough to reach some portion of the shank 18. At this time, the conductive shank 18 has made sufficient electrical contact or arc with the electrical portion surface 13 to provide the initial pulse 60. According to the invention, the size of the facet 17 is then the desired size and no further lapping is needed. Accordingly, the lapping circuit 44 functions in response to signal B to energize the mechanism 24 to lift the holder 20 and thus the diamond tip 16 from the surface 13 and cease the operation of lapping.

In another embodiment of the invention, the weight 26 is 30 grams, which shortens the lapping time to a period of about 5 to 15 seconds. In this embodiment, the "stable" oxide layer thickness, described in detail above, is reduced greatly for two reasons. First, the oxide removal rate is greatly increased, and second, since the titanium shank 18 is in intimate contact with the scaife 12 a higher percentage of the time (due to less "bouncing"), less oxygen is available to form new titanium oxide. Thus, the titanium oxide thickness will reduce quickly to a stable value whereby a bias of as little as 5 volts is sufficient to provide reliable operation to detect the first pulse 60.

In this embodiment, with the heavier weight 26 and smaller voltage from bias supply 28, the portions 66 to 68 of waveform of signal A (FIG. 4) are achieved quickly and detection circuitry can be simplified. Detection circuit 36 and latch circuit 39 can be replaced by a computer, such as type AIM 65 computer manufactured by the Rockwell Corporation or a Hewlett Packard type 9825. Because signal portion 68 is achieved quickly, the computer is programmed to respond to the DC level of portion 68 to generate the DC signal waveform B. Waveform signal B, for this embodiment, will be initiated relative to signal A not as shown in FIG. 4, but rather, at the time when the DC portion 68 of signal A is developed. In such an arrangement, the resistor R can be about 10,000 ohms and capacitance C can, again, be the stray lead capacitance because the time constant T is no longer critically important.

The invention thus provides an accurate and reliable way to lap a facet into a conical diamond tip brazed to a metallic shank by sensing the electrical pulse or arc that is generated as the facet extends to or near the shank. The size of the facet has been found, when controlled by this invention, to be of proper size to serve after being metallized as the electrode facet of the stylus. The facet size is large enough to form a serviceable electrode surface, but yet not so large as to require excessive lapping time or permit lapping into the titanium shank 18, thereby undesirably contaminating the scaife with metal particles.

What is claimed is:

1. Apparatus for controlling the lapping of a stylus having a conical diamond tip bonded to an electrically conductive shank, said shank formed of a rapid oxidizing metal comprising:

(a) means for removably supporting said stylus positioned with said tip in contact with the surface of a rotating electrically conductive scaife having abrasive diamond particles embedded in the surface of the scaife;

(b) means for providing a DC bias to establish an electric field between said shank and said scaife;

(c) means for detecting an electrical signal and providing a control signal responsive thereto when said diamond tip is sufficiently lapped in the vicinity of said shank to lower the conductive shank close enough to the scaife to break down said electric field or make electrical contact between said shank and scaife;

(d) means responsive to said control signal for removing said tip from contact with said scaife to thereby cease lapping the stylus; and (e) means to provide a preselected force of said stylus tip on said surface having a value lying in the range of 2 to 30 grams and wherein said DC bias has a value lying in the range of 5 to 100 volts, the respective values of said force and DC bias being selected to break down the insulation of oxide that exists on said shank to thereby detect said electrical signal.

2. Apparatus according to claim 1 wherein said detecting means comprises a circuit for generating a pulse having an initial transient of about 1 microsecond and a recovery transient in the range of about 0.1 to 10 milliseconds.

3. A method for controlling the lapping of a stylus having a conical diamond tip brazed to a shank, said shank formed of a rapid oxidizing metal comprising the steps of:

(a) removably positioning said stylus tip in contact with the surface of a rotating electrically conductive scaife having abrasive diamond particles embedded in the surface of the scaife;

(b) providing a DC bias to establish an electric field between said shank and said scaife;

(c) detecting an electrical signal and providing a control signal responsive thereto when said diamond tip is sufficiently lapped in the vicinity of said shank to lower the conductive shank close enough to the scaife to break down said electric field or make electrical contact between said shank and scaife;

(d) removing in response to said control signal said tip from contact with said scaife to thereby cease lapping the stylus; and (e) providing a preselected force of said stylus tip on said surface having a value lying in the range of 2 to 30 grams and wherein said DC bias has a value lying in the range of 5 to 100 volts, the respective values of said force and DC bias being selected to break down the insulation of oxide that exists on said shank to thereby detect said electrical signal.

4. The method according to claim 3 wherein said electrical signal is a pulse having an initial transient of about 1 microsecond and a recovery transient in the range of about 0.1 to 10 milliseconds.

* * * * *